United States Patent [19]

Quisenberry

[11] Patent Number: 4,905,351

[45] Date of Patent: Mar. 6, 1990

[54] AIRLINE CLEANER FOR SEED COTTON

[76] Inventor: Robert L. Quisenberry, P.O. Box 64113, Lubbock, Tex. 79464

[21] Appl. No.: 234,217

[22] Filed: Aug. 19, 1988

[51] Int. Cl.[4] ..... D01B 1/06

[52] U.S. Cl. ..... 19/0.44

[58] Field of Search ..... 19/39, 40, 41, 43, 44; 209/135; 210/391; 15/256.5

[56] References Cited

U.S. PATENT DOCUMENTS

| | | | |
|---|---|---|---|
| 2,144,579 | 1/1939 | Sheppard, Jr. | 19/44 |
| 2,644,986 | 7/1953 | Pazandak | 19/44 |
| 2,993,598 | 7/1961 | Lenhart | 209/135 |
| 3,009,574 | 11/1961 | Burdett | 209/135 |
| 3,805,332 | 4/1974 | Williams et al. | 19/44 |
| 4,520,529 | 6/1985 | Davis | 19/44 |

*Primary Examiner*—Werner H. Schroeder
*Assistant Examiner*—D. Price
*Attorney, Agent, or Firm*—Wendell Coffee

[57] ABSTRACT

An airline cleaner has a cylindrical cage coaxial and the same diameter as a pipe connected to either end of the cage. Helical vanes around the circumference of the cage cause the air and seed cotton moving through the pipe in the cage to move in a helical motion as they move through the cage. The helical motion will wipe the seed cotton against the cage, and trash will fall through spaces in the cage, thus being removed from the seed cotton. A housing surrounds the cage.

10 Claims, 1 Drawing Sheet

AIRLINE CLEANER FOR SEED COTTON

BACKGROUND OF THE INVENTION (1) Field of the Invention

This invention relates to the preparation of cotton and particularly to cleaning seed cotton before it is ginned.

Cotton ginners are skilled in the art of cleaning seed before it is ginned; and therefore, a cotton ginner is one ordinary skill in this art.

(2) Description of the Related Art

Modern cotton harvesting is by machine. Most of the cotton is harvested by cotton strippers which strip the entire boll of cotton, including the cotton burr, from the stalk also harvesting stems, sticks, leaves, and other trash.

The harvested material will include lint cotton, cotton seed, cotton burr, stems, leaves, sand, dirt, and other trash.

The harvested material is referred to as seed cotton. The cotton even after having the burrs, sticks, leaves, and other trash removed from it is also referred to as seed cotton. After the seed are removed, the seed are referred to as cotton seed, and the lint is referred to as cotton lint. Often, everything except the cotton lint and cotton seed are referred to as trash although the trash sometimes is identified by individual components such as burrs, stems, sticks, leaf trash, sand, and other trash.

At the time of harvesting, some trash is removed from the seed cotton. Many developments have been made for removing greater amounts of trash, including most of the burrs. The cleaning done during harvesting would be included with the harvesting equipment.

Customarily, the first step in preparation of seed cotton at the cotton gin is to clean the seed cotton by an airline cleaner. Normally, the seed cotton is conveyed from transport means into the cotton gin by entraining the seed cotton in an air stream, commonly called a suction. The first step is that the airline cleaner, i.e., to clean the seed cotton while it is still air conveyed. Often these airline cleaners include beaters which wipe the seed cotton across a woven wire screen. Thereafter, other machines remove burrs that are in the seed cotton (even if some burr removal is taking place upon the harvesting equipment, not all burrs are removed at that time). Thereafter, the seed cotton may be again cleaned before it is ginned. The ginning process is the process of separating the lint from the seed. After the cotton is ginned, often the lint is cleaned at the cotton gin. From there, the cotton lint is pressed into bales, and the bales are transported to a spinning mill. At the spinning mill, the lint cotton is often cleaned again before the carding and spinning process begins.

SUMMARY OF THE INVENTION (1) Progressive Contribution to the Art

According to this invention, the seed cotton, as soon as it is brought into the gin by suction, is caused to have a helical motion at the time it passes through a cage. The helical motion tends to cause the cotton to go to the circumference of the cylindrical cage by centrifugal force. Therefore, the helical motion is induced at the cage. This is done by having the cage with about the same diameter as the pipe that is conveying the seed cotton and to have vanes at the cage to cause the seed cotton to follow a helix in its movement. As the seed cotton is wiped across the bars of the cage, or as it rubs against it, the sand and other trash pass through the spaces between the bars, whereas the locks of seed cotton remain in the cage.

The preferred embodiment is to have the cage built of rods which are spaced apart, with about ⅜" space between the rods. However, it is also contemplated that the cage could be made of a heavy woven screen wire.

(2) Objects of this Invention

An object of this invention is to clean trash from seed cotton.

Further objects are to achieve the above with devices that are sturdy, compact, durable, lightweight, simple, safe, efficient, versatile, ecologically compatible, energy conserving, and reliable, yet inexpensive and easy to manufacture, connect, adjust, operate and maintain.

Other objects are to achieve the above with a method that is rapid, versatile, ecologically compatible, energy conserving, efficient, and inexpensive, and does not require highly skilled people to connect, operate, and maintain.

The specific nature of the invention, as well as other objects, uses, and advantages thereof, will clearly appear from the following description and from the accompanying drawing, the different views of which are not scale drawings.

Figure 1:
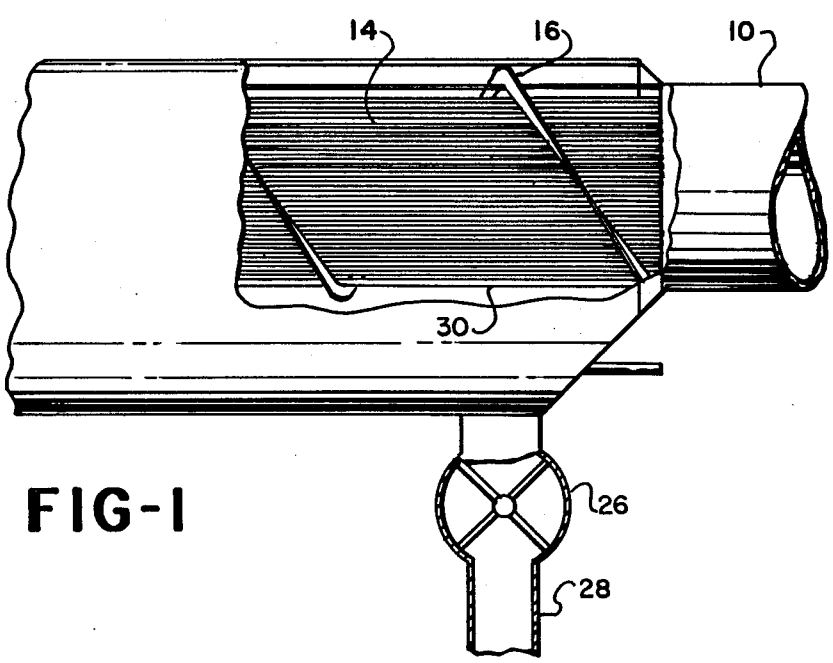
FIG. 1 is a foreshortened side elevational view of an embodiment of this invention with parts broken away to show internal construction.
Figure 2:
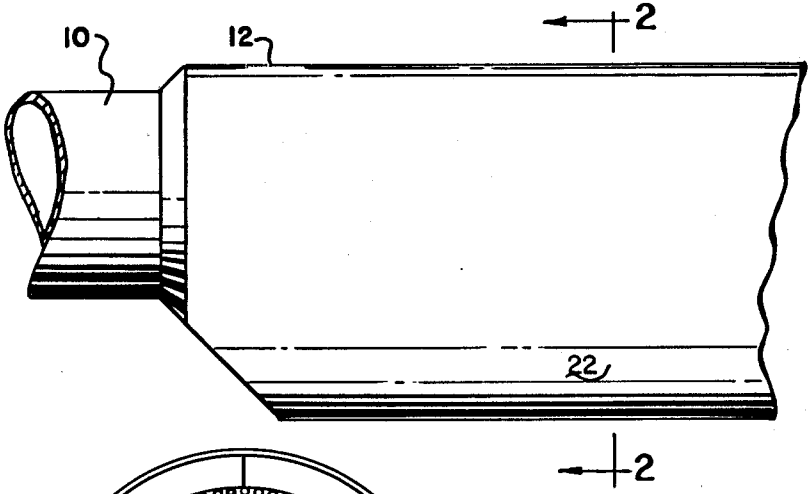
FIG. 2 is a cross sectional view taken substantially on line 2—2 of FIG. 1.
Figure 2:
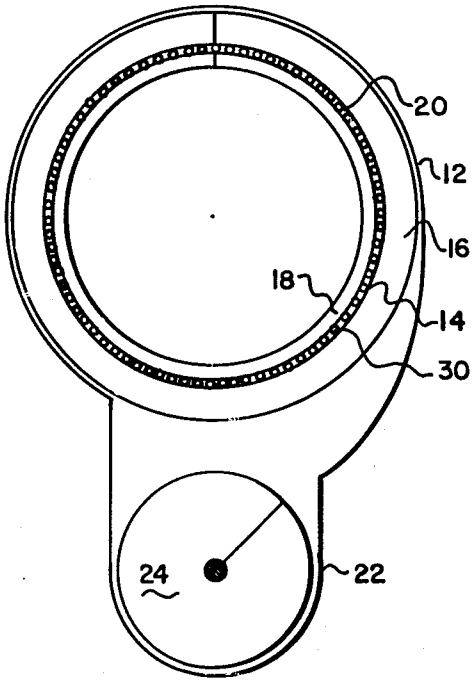
Figure 3:
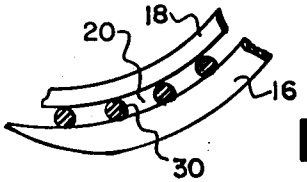
FIG. 3 is a detail of a part of the cage and vanes with parts in section.

As an aid to correlating the terms of the claims to the exemplary drawing, the following catalog of elements and steps is provided:

10: pipe
12: housing
14: cage
16: outer vane
18: inner vane
20: spaces
22: trough
24: auger
26: air lock
28: trash pipe
30: rods

DESCRIPTION OF THE PREFERRED EMBODIMENT

Referring to the drawing, there may be seen pipe 10 which carries seed cotton entrained in a stream of air. Such operations are well known in the cotton ginning art wherein one end of the pipe 10 is connected to a telescoping suction pipe with sucks the cotton up from trailers or the like, and the other end of the pipe 10 is connected to an intake end of a fan or blower to cause the suction within the pipe.

Housing 12 is connected to the pipe 10. Within the housing is cage 14. The cage is preferably constructed of parallel rods 30 extending the length of the housing. The inside diameter of the rods is the same as the inside diameter of the pipe, and a connection is made. It will be understood that as the cotton is blown through the pipe, that any irregularities of the connection of the rods to the pipe will cause cotton or trash to snag, causing problems in operation.

The pipe 10 will have an axis and a diameter. The housing 12 is basically cylindrical, and it will also, therefore, have an axis. The cage 14 is cylindrical, and it too, will have an axis. The axis of the cage and the housing are coaxial with the pipe; and therefore, coaxial with one another. The cage has an inside diameter which is about the same as the inside diameter of the pipe 10. Outer helical vane 16 extends between the cage 14 and the housing 12. It is connected to the cage, e.g., by welding. The vane 16 forms a helix around the cage 14.

Inner vane 18 extends radially inward inside the cage. The pitch of the vane 18 are the same as the pitch of the vane 16, and it too, forms a helix.

The two helical vanes 16 and 18 cause a helical motion to the seed cotton and the air. By centrifugal force of the helical motion, the seed cotton will be thrown outward against the inside surfaces of the cage so that the seed cotton is wiped against the cage. The trash will move between spaces 20 in the cage 14 while the locks of seed cotton will be retained within the cage.

After the trash, particularly leaf trash, sticks, stems, and sand fall through the cage, they will fall within trough 22, which is a portion of the housing beneath the cage 14. Auger 24 within the trough will convey the trash to air lock 26. The air lock will have rotating paddles so that the trash falls out the trash pipe 28 without excessive loss of air. A certain amount of air leakage is permissible.

It will be understood that the series of rods 30 forming the cage 14 will form a screen. As pointed out above, a woven wire screen could be used. Those having ordinary skill in the art will understand that the spaces 20 between the rods are a width which will prevent locks of cotton from being lost between the rods. Generally about ⅜" wide space will operate satisfactorily. The preferred form is to have a cage about 20 feet in length connected to a pipe of about 15" in diameter. The rods within the cage are 5/16" in diameter, which would be on 11/16" center so that there is a ⅜" space between adjacent rods. Also, the outer vane 16 would be formed of a strip of metal 1½ wide and ⅛" thick, while the inner vane 18 would have half the width or radial dimension of the outer vane. The inner vane would be ¾" wide and ⅛" thick. The vanes would be welded to the rod cage.

The vanes form means for causing the air and the seed cotton to have a cylindrical or helical motion while traveling through the cage. This cylindrical motion forces the trash from the seed cotton through the spaces in the cage while maintaining the seed cotton within the cage. Of course, the trash is collected in the trough and conveyed away from the cage for disposal.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. An airline cleaner for cleaning seed cotton entrained in a stream of air traveling in:

a. a cylindrical pipe having
   i. an axis, and
   ii. a diameter;
b. wherein the improvement comprises in combination:
c. a cylindrical cage coaxial with the pipe,
d. a screen having spaces forming the circumference of the cage,
e. the spaces of the screen large enough to permit the passage of trash and air but small enough to contain the seed cotton,
f. an airtight housing spaced outside of the cage,
g. said airtight housing connected to said pipe at each end of the housing, and
h. a helical vane within the housing coaxial with the cage for causing helical flow of the air and seed cotton within the housing and within the cage.

2. The invention as defined in claim 1 wherein said cylindrical cage has about the same diameter as the pipe.

3. The invention as defined in claim 1 wherein said screen is made of a plurality of rods parallel to the axis of the cage.

4. The invention as defined in claim 1 wherein:

j. said helical vane extends between the cage and the housing and also projects toward the axis from the inside of the cage.

5. The invention as defined in claim 4 wherein:

k. the radial dimension of the vane from the cage to the housing is twice the radial dimension of the vane projecting within the cage.

6. The invention as defined in claim 1 further comprising:

j. a trough formed in the bottom of said housing,
k. said trough having an auger therein for conveying trash to one end of the housing, and
l. an air lock below the trough for dropping the trash from the cleaner without excessive loss of air from the cleaner.

7. The invention as defined in claim 6 wherein said cylindrical cage has about the same diameter as the pipe.

8. The invention as defined in claim 7 wherein:

m. said helical vane extends between the cage and the housing and also projects toward the axis from the inside of the cage.

9. The invention as defined in claim 8 wherein:

n. the radial dimension of the vane from the cage to the housing is twice the radial dimension of the vane projecting within the cage.

10. The invention as defined in claim 9 wherein said screen is made of a plurality of rods parallel to the axis of the cage.

* * * * *